US006715448B1

(12) United States Patent
McComb

(10) Patent No.: US 6,715,448 B1
(45) Date of Patent: Apr. 6, 2004

(54) REMOTELY ADJUSTABLE EQUESTRIAN BARRIER

(76) Inventor: Michael C. McComb, 9634 Belinder Rd., Leawood, KS (US) 66206-2153

( * ) Notice: Subject to any disclaimer, the term of this patent is extended or adjusted under 35 U.S.C. 154(b) by 0 days.

(21) Appl. No.: 10/461,645

(22) Filed: Jun. 13, 2003

(51) Int. Cl.[7] ..... A01K 29/00
(52) U.S. Cl. ..... 119/705; 482/15
(58) Field of Search ..... 482/15, 16, 17; 119/705, 174

(56) References Cited

U.S. PATENT DOCUMENTS 3,497,212 A * 2/1970 Gotcher ..... 482/17
4,368,875 A * 1/1983 Weiss et al. ..... 256/59
4,414,920 A 11/1983 Richards et al.
4,765,412 A 8/1988 Colonel et al.
4,823,883 A 4/1989 Colonel et al.
4,827,873 A 5/1989 Wong
4,989,821 A 2/1991 Wong
5,520,595 A * 5/1996 Lee ..... 482/17
5,586,520 A 12/1996 Cleary
D380,371 S 7/1997 Maher et al.
5,679,105 A * 10/1997 Vittone et al. ..... 482/93
5,690,583 A 11/1997 Keusch
D395,226 S 6/1998 Maher et al.
5,913,283 A * 6/1999 Coury ..... 119/705
5,924,386 A 7/1999 Lewis
5,967,093 A 10/1999 Vitt et al.
6,263,835 B1 * 7/2001 Santi ..... 119/705
6,520,119 B1 2/2003 Johnson

* cited by examiner

*Primary Examiner*—Thomas Price
(74) *Attorney, Agent, or Firm*—Chase Law Firm, L.C.

(57) ABSTRACT

A remotely adjustable equestrian barrier includes motors mounted to the barrier posts and linked to sliding jump cups. The motors are microprocessor controlled. The rail height is adjusted using a remote transmitter which directs the microprocessor to energize the motors and thereby move the rail. Position sensors provide information to the microprocessor to determine when to de-energize the motors. A collapsible barrier may be used with the remotely adjustable equestrian barrier.

20 Claims, 12 Drawing Sheets

REMOTELY ADJUSTABLE EQUESTRIAN BARRIER

BACKGROUND OF THE INVENTION

This invention relates to equestrian barriers and, in particular to an equestrian barrier, the height of which may be remotely adjusted.

Existing training and show jumping courses for equestrian jumping typically include a number of static jump barriers each consisting of a pair of standards and one or more rails extending between the standards which a horse must clear. When training a horse it is often desirable to vary the height of the rail, moving it up and down from jump to jump to help the horse gain confidence. However, as the rider guides the horse around the ring, either another person must adjust the rail height, or the rider must stop, dismount and adjust the height of the rail. This procedure is often disruptive to the horse causing the horse to lose its rhythm and consequently its confidence.

At a show or competition, a course of equestrian jumps is set up. From class to class or age group to age group, the heights of the rails must be changed. The rails are adjusted manually according to the show schedule. This often results in a description to the flow of the competition, requires many workers, and is subject to errors as the rails are adjusted from one height to another around the course.

BRIEF SUMMARY OF THE INVENTION

The present invention includes a remotely controlled jump cup adjustment mechanism secured to each standard. The height of the rail may be adjusted up or down incrementally or to one of many preset heights. The present invention includes a transmitter and receiver. The receiver provides input to a motor control circuit which may include a microprocessor, which in turn operates a pair of motors, one for each side of the rail. Each motor is linked to a sliding or rolling cup which travels up and down the standard to adjust the height of the rail between the two standards.

DETAILED DESCRIPTION

Figure 1:
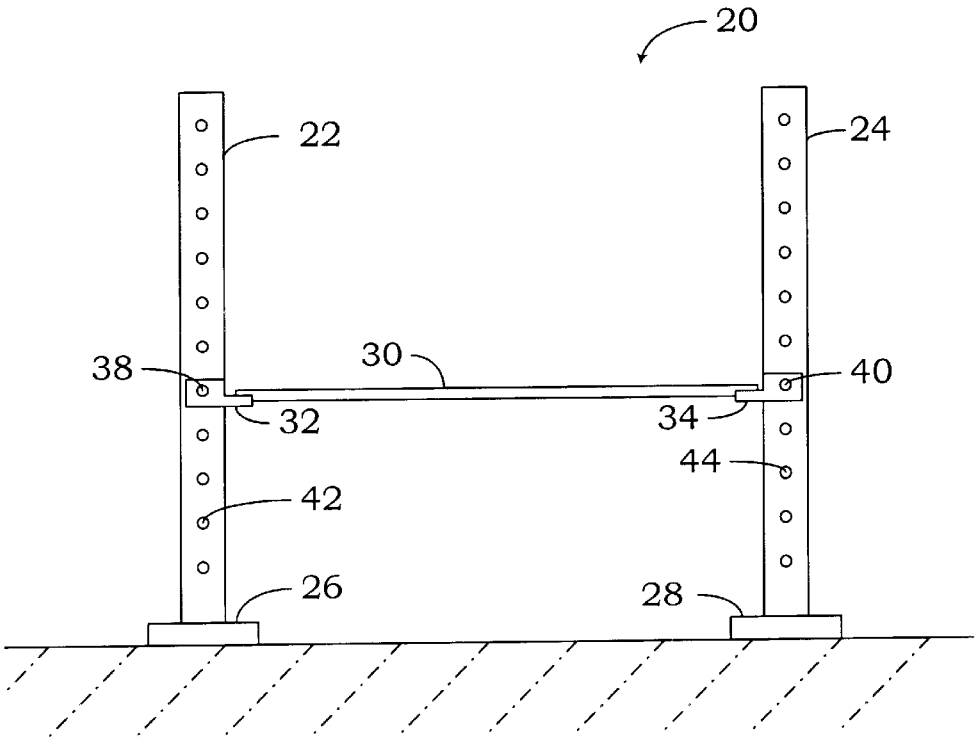
Fig. 1 PRIOR ART
FIG. 1 is a front elevational view of a prior art equestrian jump.

Referring to FIG. 1, a prior art horse jump is generally indicated by reference numeral 20. Horse jump 20 includes a pair of upright standards 22 and 24 which are each typically constructed of an upright 4"×4" pressure treated post and a base 26 and 28.

A rail 30 extends between standards 22 and 24 and rests in jump cups 32 and 34. Rail 30 may be vertically adjusted by removing the rail pins (not shown) which extend through apertures 38 and 40 in jump cups 32 and 34 and apertures 42 and 44 in standards 22 and 24 and moving the jumps cup 32 and 34 to the desired height and reinserting the pins to secure the jump cup at the desired height. Apertures 42 and 44 are typically spaced three inches apart to allow incremental manual adjustment of the height of rail 30 above the ground.

Figure 2:
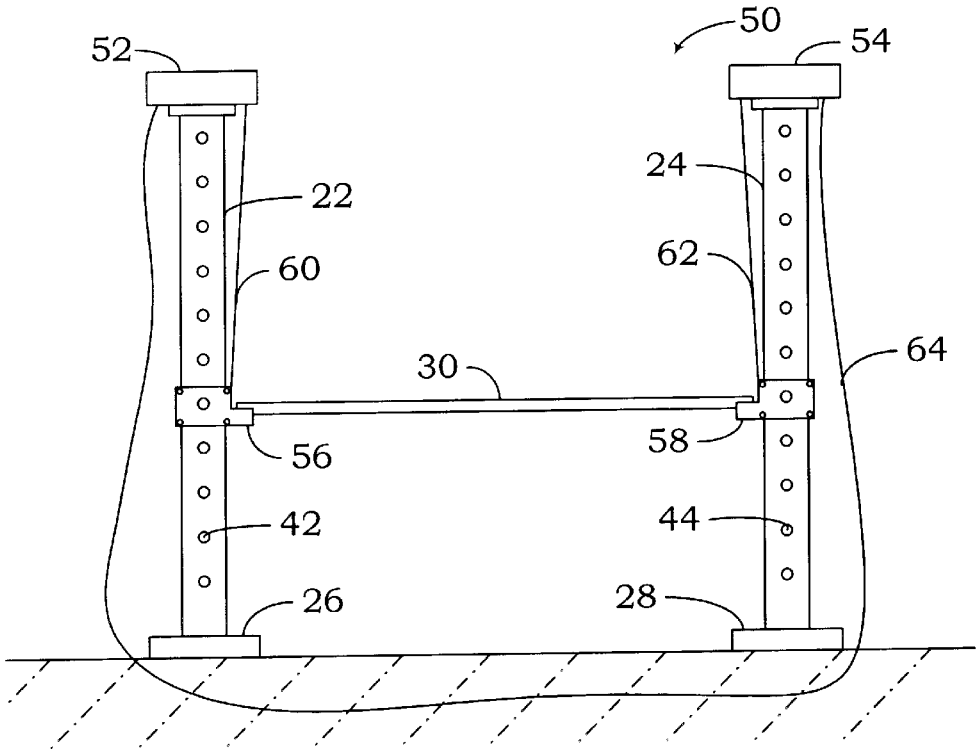
FIG. 2 is a front elevational view of the remotely adjustable equestrian barrier of the present invention.

Referring to FIG. 2, the remotely adjustable equestrian barrier of the present invention is generally indicated by reference numeral 50. Remotely adjustable equestrian barrier 50 includes a primary motor control housing 52 and a secondary motor housing 54 which are secure to posts 22 and 24. Rail 30 extends between rolling jump cups 56 and 58 which are linked to primary control housing 52 and secondary motor housing 54 by lines 60 and 62 respectively. A power and control wire 64 extends from the primary motor control housing 52 to the secondary motor housing 54. Typically wire 64 is covered with a thin layer of earth or otherwise concealed between posts 22 and 24 so at to make it invisible to the horse and rider.

Figure 3:
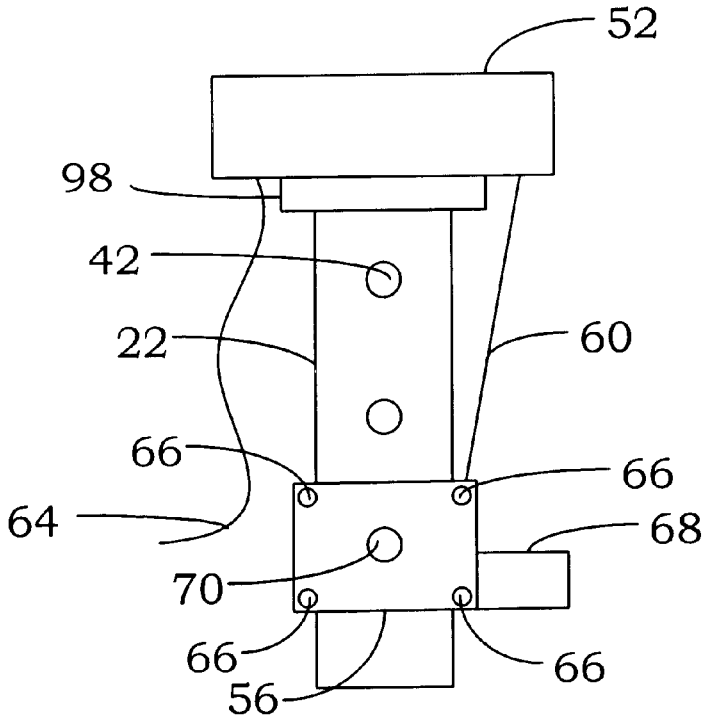
FIG. 3 is an enlarged front view of one of the posts of FIG. 2.
Figure 4:
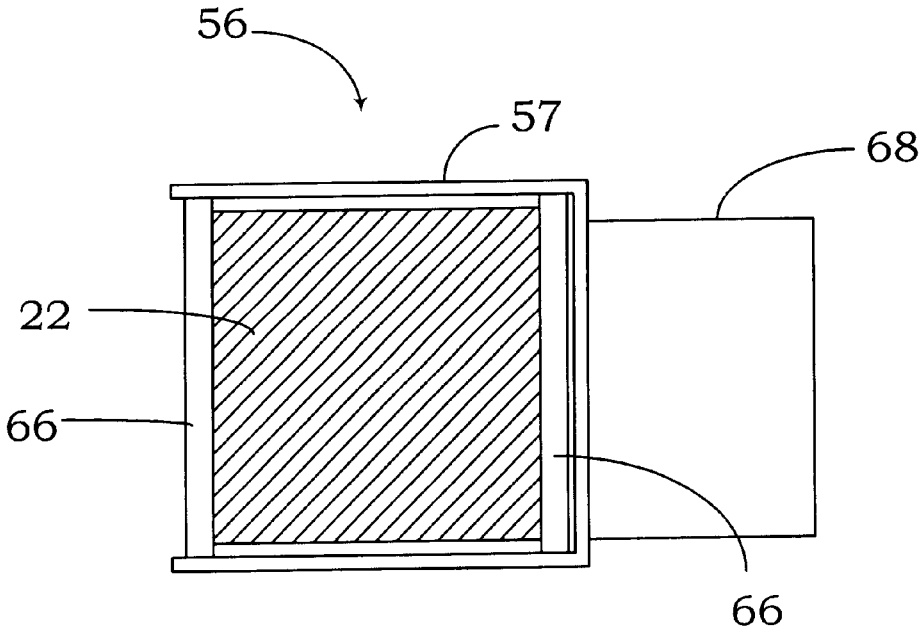
FIG. 4 is a top plan view of the jump cup of FIG. 3.

Referring to FIGS. 3 and 4, primary motor control housing 52 is attached to the top of post 22. A line 60 extends from housing 52 and attaches to rolling jump cup 56. Jump cup 56 includes a generally U-shape bracket 57, four rollers 66 extending between the legs of bracket 57 and which freely ride on the outside surfaces of post 22, a rail support cup 68 and aperture 70, which allows the jump cup 56 to be used in the conventional manner and temporarily secured to post 22 using a locking pin (not shown). Jump cup 56 may be constructed from a 5"×5" square tube with four pair of roller on the inside of all sides (not shown).

Figure 5:
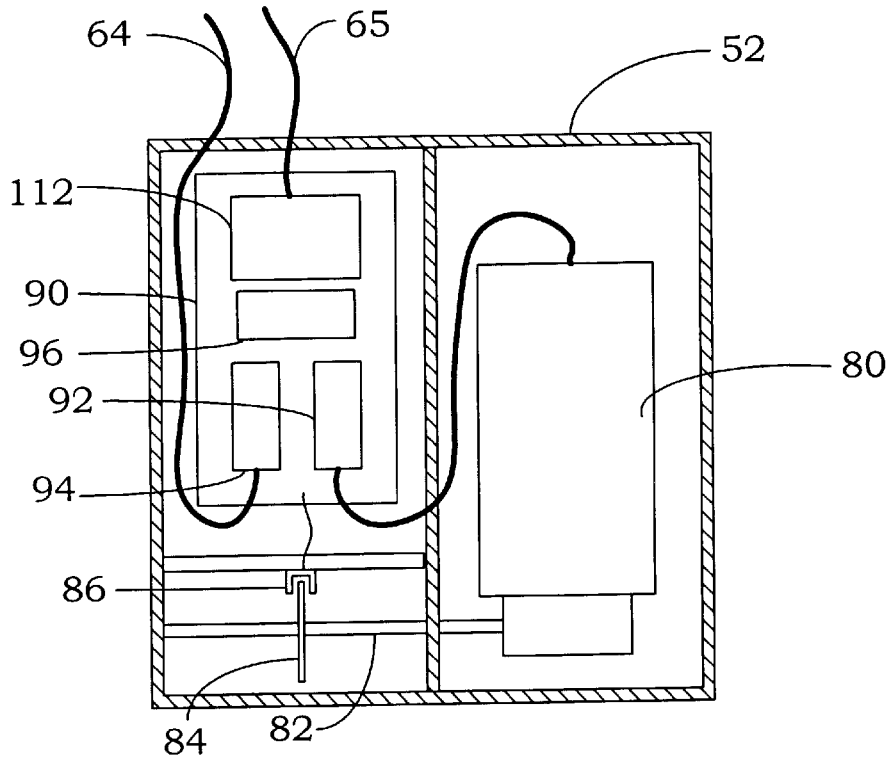
FIG. 5 is a sectional plan view of the primary motor control housing of FIG. 2.
Figure 6:
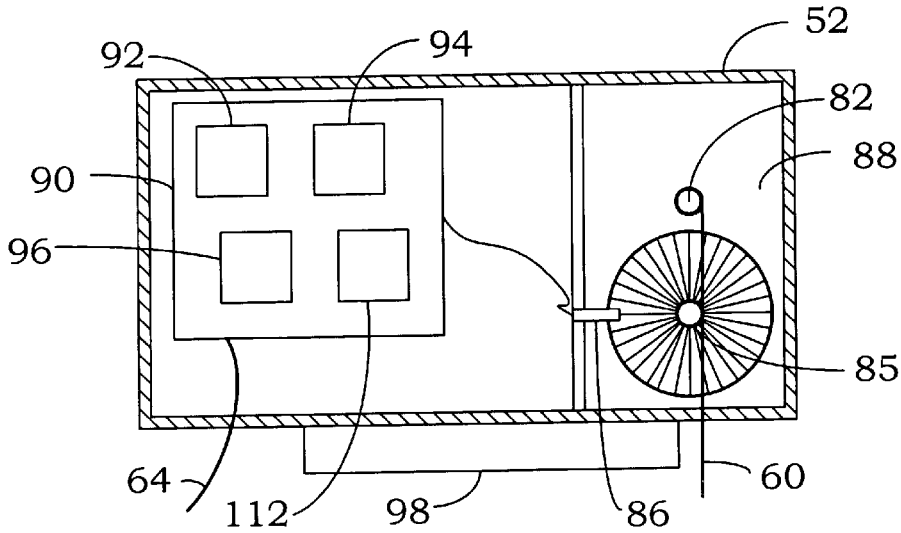
FIG. 6 is a sectional side elevational view of FIG. 5.
Figure 7:
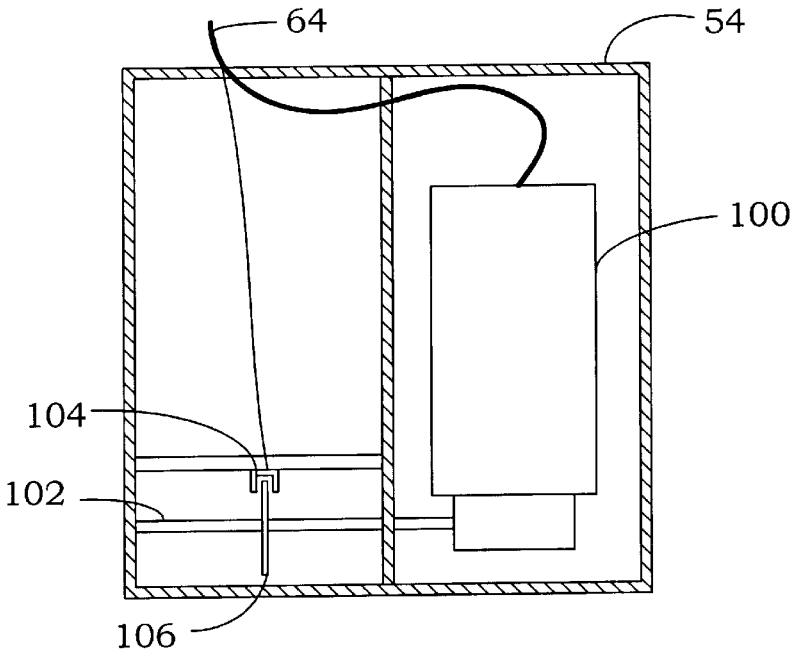
FIG. 7 is a sectional plan view of the secondary motor housing of FIG. 2.

Referring to FIG. 5–7, primary motor control housing 52 includes a motor 80 and shaft 82, an encoder wheel 84, and encoder wheel shaft 85, a rotation sensor 86 and a controller circuit board 90. The controller circuit board 90 includes a microprocessor 112, a primary motor controller 92, a secondary motor controller 94, a RF receiver/decoder 96 and a signal booster 97. A post mounting bracket 98 secure the housing 52 to the top of a post 22. Secondary motor housing 4 includes a motor 100 and shaft 102, a rotation sensor 104, encoder wheel 10 and an encoder wheel shaft (not shown).

Primary and secondary housings 52 and 54 may be constructed of plywood or other material such as high-strength plastic. In the typical equestrian arena, jump are typically made of wood or plastic to protect the horses and riders.

Figure 8:
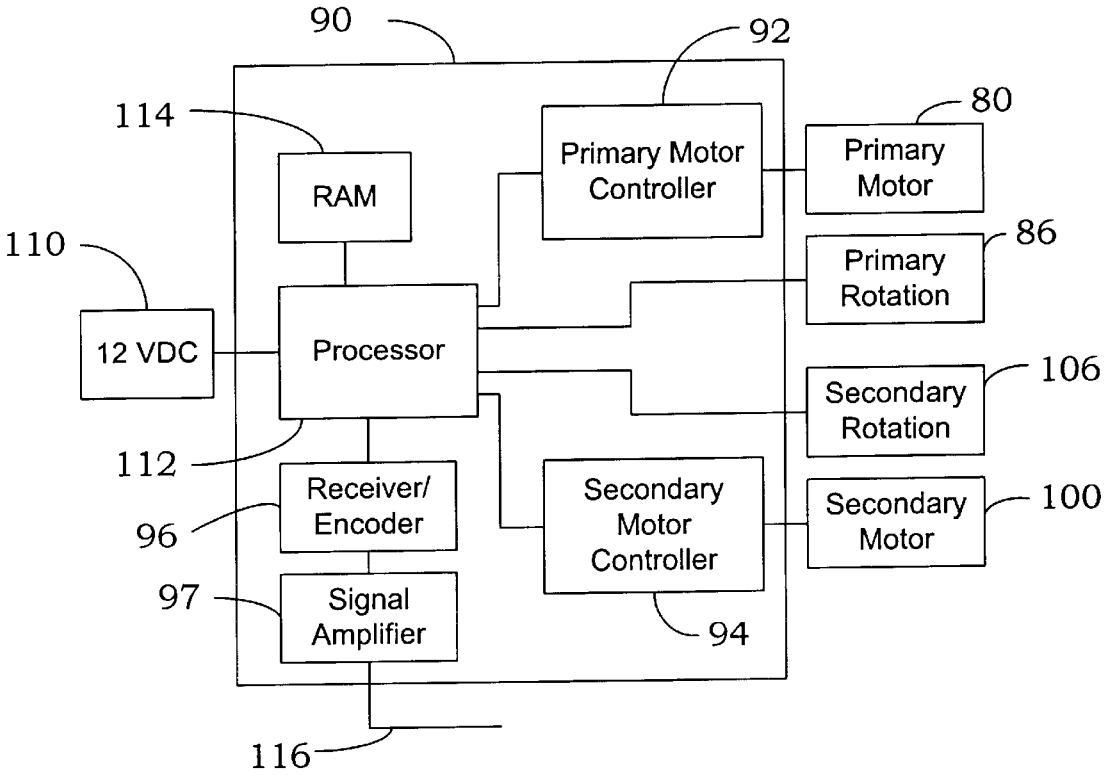
FIG. 8 is a diagram of the motor control circuit.

Referring to FIG. 8, the controller circuit 90 receives power from a 12-volt DC battery 110. Controller circuit 90 includes a microprocessor 112 with a memory 114. Microprocessor 112 receives commands from receiver/decoder 96 from antenna 116 to change the height of a rail, for example. Microprocessor 112 sends "up" or "down" commands to the primary motor controller 92 and the secondary motor controller 94 which direct the rotation of motor 10 and 100. Motors 80 and 100 rotate shafts 82 102 which turn encoder wheels 84 and 106 on encoder shaft 85 and the secondary encoder shaft (not shown) respectively. As the encoder wheels 84 and 106 turn, rotation sensors 86 and 108 detect the marks on the encoder wheels 84 and 106 which are counted by microprocessor 112 to determine the incremental distance a rail has moved. When the desired position is reached, microprocessor 112 disables the motor controller 92 and 94 which in turn stop motors 80 and 100. Encoder wheels 84 and 106 may be secured directly to shafts 82 and 102 eliminating the need for a second encoder shaft.

In the preferred embodiment, processor 112 may be a BasicX BX-24 processor chip for example. A BX-24 development board may be used to mount the processor 112 and RF receiver 96. An X10 RF transmitter may be used to transmit RF to the signal booster 97 and receiver 96. In small arenas signal booster 97 may not be needed. These transmitters provide digitally encoded signals, are inexpensive and come in several sizes from a key chain attachable unit to desktop size units. A Saturn L-series windshield motor may be used for drive motors 80 and 100. The Saturn windshield motor includes a 90 degree worm gear drive shaft and is capable of forward and reverse operation. Stepper motors may also be used obviating the need for the rotational sensors 86 and 108 and encoder wheels 84 and 106. A Dacron® line may be used to link the drive shafts to the rolling jump cups. Chain, wire or other string may also be used. The motor housings 52 and 54 may be glued or otherwise fastened together. Two high power H-bridge drives available from Robotics HK of Hong Kong may be used to control the motors.

Figure 9:
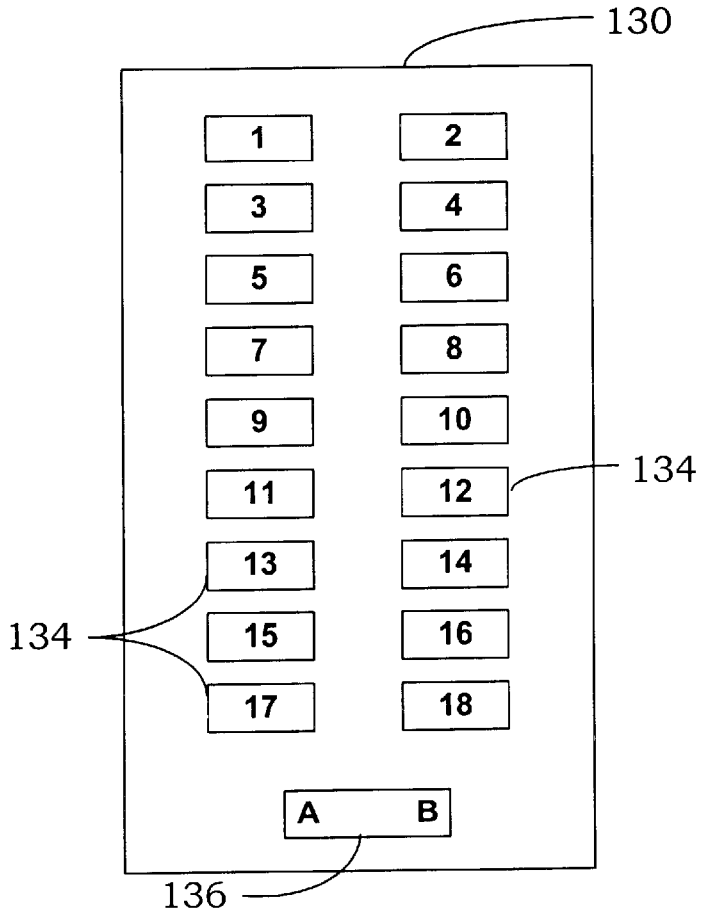
FIG. 9 is an illustration of a remote control unit.
Figure 10:
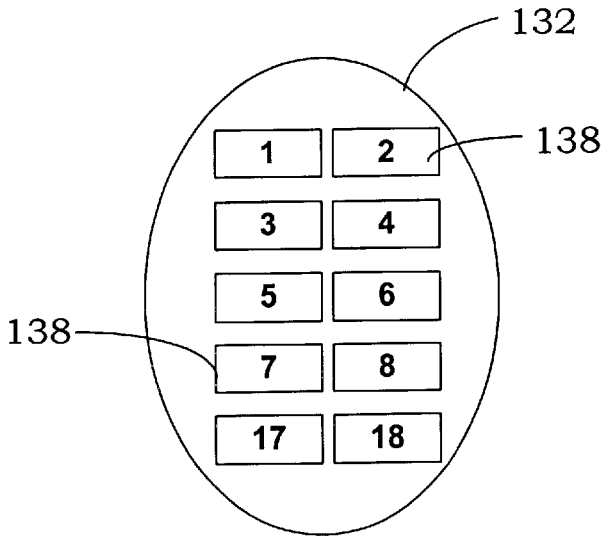
FIG. 10 is an illustration of compact remote control unit.

Referring to FIGS. 9 and 10, remote control units 130 and 132 are illustrated. Remote control unit 130 provides eighteen position buttons 134 and a 2-position selector switch 136. When one of the buttons 134 is depressed, position transmitter 130 sends an encoded signal to antenna 116 and receiver/decoder 116 in the primary motor control housing 52. When the selector switch 136 is in the A-position and the button pushed is button 3 through 16, the encoded signal is interpreted by the microprocessor 112 as incremental direction information. When selector switch 136 is in the B-position, the encoded signal is interpreted as position information or a store command to save the current position for a particular button 134.

Remote control unit 132 is a smaller, compact transmitter with buttons 138 which may be used in a similar way as remote control unit 130. Remote control unit may be more conveniently carried by a rider to dynamically change the height of a jump while riding a horse during a training or practice session.

Remote control units 130 and 132 are preferably radio frequency (RF) transmitters. However, other transmitters such as optical or infrared transmitters or a hardwired data link for a fixed system may be used.

Referring to FIG. 9 the selector switch 136 may be set to either the "A" or "B". Referring to FIG. 10 there is no selector switch and the unit is always in the "A" mode.

When the jump unit is first powered up the microprocessor sets the system to mode 0 (zero). No controller functionality is available other than mode selection until a mode is actually selected by pressing either button 1 or button 2.

When a button is depressed a digital signal is sent from the transmitter 130 or 132 to the receiver 96. Embedded within this signal is not only the identity of the particular button pressed but also the setting of the A/B selector switch. Every button press transmits the position of the A/B selector switch.

Buttons 1 and 2 on the controllers 130 and 132 may be used to set the mode under which the microprocessor operates. When the selector switch 136 is in the "A" position mode 2 or 1 may be selected by pressing either button 1 or button 2. When the selector switch is in the "B" position mode 3 or 4 may be selected by pressing button 1 or button 2. Controller 132 lacks a selector switch and is therefore in the "A" mode and thus only modes 1 or 2 may be selected.

When the power is first turned on the system is in the mode 0 state. There are a total of four operational modes plus the startup mode that exists until one of the modes is selected. Button 1 or 2 (in either selector switch position "A" or "B" position) may be pressed to activate one of the four modes of operation. Buttons 3 through 18 may have no functionality until an operational mode is selected.

Once a mode is selected buttons 3 through 16 provide different functionality depending on which mode is selected. Once a mode is selected buttons 17 and 18 buttons provide the same functionality in all four operational modes. Button 17 being depressed causes the jump rail to be lowered in three-inch increments. Button 18 being depressed causes the jump rail to rise in three-inch increments.

With the selector switch 136 is in position "A" when button 1 is depressed the microprocessor program enters mode 2. Mode 2 is a set up mode. It is used to make two different adjustments to the jump rail 30 (FIG. 2). First, the rail may be adjusted so that the rail is at the top of the range of movement that it will attain in all other modes of operation. This is the zero position. Once the zero position is established, the rail may not move any higher. Second, the position of the two cups 56 and 58 (FIG. 2) may be adjusted so that each jump cup is of equal distance above the ground and so that the rail 30 will be generally parallel to the ground. If the ground is not level, the jump cups 56 and 58 may be independently adjusted so that the rail 30 is generally level.

The height of the jump cups 56 and 58 may also be established using a laser or laser range finder (not shown) mounted on the housings 52 and 54 pointing at the top of rail 30 or mounted on the lower side of each jump cup pointing at the ground or the bases 26 and 28, for example. Input from the laser in the form of digital data may be used by the microprocessor 112 to calculate the height of the rail 30 and to adjust it accordingly.

While in mode 2 the jump cups may be adjusted together in a downward direction by depressing buttons 13, 15 or 17. Button 13 causes both cups 56 and 58 to descend by one increment of the rotational sensor. Button 15 causes both cups to descend by one inch as detected by the rotational sensors. Button 17 causes both cups to descend by three inches as detected by both rotational sensors. The buttons directly adjacent to buttons 13, 15 and 17 are respectively buttons 14, 16 and 18. Buttons 14, 16 and 18 being depressed cause both cups to raise by 1 increment, 1 inch and 3 inches respectively. By using these buttons one can precisely position both cups at the top of the range of motion that will be allowed in other modes of operation.

While in mode 2 the cup 56 attached to the primary controller box 52 (FIG. 2) is adjusted in a downward direction by depressing buttons 3, 5, and 7. Button 3 causes cup 56 to descend by one increment of the rotational sensor. Button 5 causes cup 56 to descend by one inch as detected by the rotational sensor. Button 7 causes cup 56 to descend by three inches as detected by the rotational sensor. The buttons directly adjacent to buttons 3, 5 and 7 are respectively buttons 4, 6 and 8. Buttons 4, 6 and 8 being depressed will cause cup 56 to raise by 1 increment, 1 inch and 3 inches respectively. By using these buttons one can precisely align cup 56 so that it is at the same level above the ground as cup 58. In mode 2 buttons 9 through 12 have no function and the microprocessor ignores the signals received when any of these buttons is depressed.

Once the two cups 56 and 58 are at an equal distance above the ground and at the extreme top of the range of movement button 2 is pressed to enter mode 1. With the selector switch in position "A" depressing button 2 enters mode 1. Mode 1 is the run or operational mode and the buttons of the controller when depressed cause both jump cups 56 and 58 to move. In mode 1 buttons 17 and 18 cause both jump cups to lower or rise in three-inch increments respectively. The jump cups will rise to the upper limit of movement that is set in mode 2 and will lower all the way to the ground.

Buttons 3 through 16 being depressed will cause both cups to move to a preprogrammed height. If the jump is set in mode 2 so that 4'3" is the top of the range of motion the depressing of buttons 3 through 16 may cause the cups to move to various heights above the ground between 4'3" and 1'0", for example. If the jump is set in mode 2 so that 5'3" is the top of the range of motion the depressing of buttons 3 through 16 may cause the cups to move to various heights above the ground between 5'3" and 2'0", for example. The incremental distance moved when a button is depressed is typically in sets of 3" as this is the traditional increment used for most horse jumps.

Moving the selector switch to position "B" and depressing the 1 button enters mode 4. In mode 4 buttons 17 and 18 cause the two jump cups to move up and down in three-inch increments. When buttons 3 through 16 are depressed in mode 4 they record the present height of the jump in association with the specific button pressed. Thus, the jump cups may be moved to any height above the ground using buttons 17 and 18 and then associate a specific button with that height above the ground. All of the buttons may be programmed to register different heights, the same height or any combination of different and same heights. The buttons may be programmed independently of each other. When power to the jump is shut off or when a different mode is entered the button settings as programmed in mode 4 are saved.

With the selector switch in position "B" depressing the 2 button FIG. 9 causes the microcomputer/jump to enter mode 3. In mode 3 when a button (3 through 16) is depressed the jump cups move to the height that was associated with the specific button during mode 4 programming. Buttons 17 and 18 still function to either raise or lower the cups in 3-inch increments.

Referring to FIGS. 11–14, the control software for microprocessor 112 is illustrated. Generally, the software operates in a continuous loop to position the rail based on commands received from a remote control unit 130 or 132. In position A, run mode, pressing one of the position buttons 3 through 16 causes the system to move the rail to a preset height. For example, pressing button 3 may move the rail to four feet. Pressing button 4 may move the rail to four feet three inches. Pressing button 5 may move the rail to three feet six inches. Pressing button 6 may move the rail to three feet nine inches. Pressing button 17 may move the rail down three inches and pressing button 18 may move the rail up three inches from the present location. If the rail is at the correct height, for example two feet, and the button assigned to two feet (button 11) is pressed again, the system "nods" by moving the rail down an inch and then back up to the correct height of two feet to let the rider know that the signal was received.

When the system starts, the rail moves to a preset position corresponding to two feet, for example. The typical post height is 66 inches, so the rail may move from ground level up to approximately 66 inches. The operator measures the height of the rail and then adjusts the height using the remote until the rail is level and at two feet, for example. Once the preset position is established, the height of the rail may be changed by pushing the buttons on the remote 130 or 132 which moves the jump to the position associated with the button pushed. A button may be associated with a specific height of the jump such as eighteen inches, for example. Or a button may be associated with an incremental adjustment of the jump height, such as up or down three inches.

In the preferred embodiment, the system starts as indicated by block 200, and looks for a signal from a remote, block 202. If no input signal is present, decision block 204, the system loops back and waits for an input signal. If an input signal is present, the signal is decoded, block 206. With each push of a button on the remote, both the position of the selector switch and the identity of the button is transmitted. If the selector switch is in the A-position, decision block 208, the identity of the button is determined. If button 1 is pressed, decision block 210, the system enters the programming mode 2 and the target height, rail height primary and rail height secondary variables are set to a value of 500, which is a preset position of three feet, block 212, for example.

In the programming mode 2, the rail height is moved to the preset position, measured and adjusted if necessary and then set and stored in the memory to orient or calibrate the microprocessor. If button 1 is pressed, decision block 210, then the other buttons are used to position and level the rail. If button 2 is pressed, decision block 214, the settings are saved, the variables are set to zero and the system enters the run mode, block 216. If button 3 is pressed, decision block 218, one is added to the rail height primary variable, block 220. If button 4 is pressed, decision block 222, one is subtracted from the rail height primary variable, block 224. If button 5 is pressed, decision block 226, the scaling factor is added to the rail height primary variable, block 228. If button 6 is pressed, decision block 230, the scaling factor is subtracted from the rail height primary variable, block 232. If button 7 is pressed, decision block 234, three times the scaling factor is added to the rail height primary variable, block 236. If button 8 is pressed, decision block 238, three times the scaling factor is subtracted from the rail height primary variable, block 240. In this manner, adjusting the height of the primary side of the rail independently from the secondary side of the rail, the rail may be leveled.

If button 13 is pressed, decision block 242, one is added to the target height variable, block 244. If button 14 is pressed, decision block 246, one is subtracted from the target height variable, block 248. If button 15 is pressed, decision block 250, the scaling factor is added to the target height variable, block 252. If button 16 is pressed, decision block 254, the scaling factor is subtracted from the target height variable, block 256. If button 17 is pressed, decision block 258, three times the scaling factor is added to target height variable, block 260. If button 18 is pressed, decision block 262, three times the scaling factor is subtracted from target height variable, block 264. Once the rail height is adjusted and leveled and button 2 is pressed, decision block 214, the mode is set to normal, and the target height, rail height primary and rail height secondary variables are set to zero, block 216 and processing returns to block 202.

If a signal is received, block 202, the signal is decoded, block 206, and if it is in position A, decision block 208 and not button 1, decision block 210, then the system next determines which button has been pressed, continuation "A".

The distance to move the rail is determined by the spacing of the segments on the transparency or slotted wheel 88 and the diameter of the encoder wheel shaft 85 (see FIG. 6). Based on these parameters, a scaling factor (SF) is established which corresponds to a distance increment in order to move the rail up or down.

For example, a ½" diameter shaft has a circumference of approximately 1½". If the transparency wheel 88 has six segments, then each transition on the encoder wheel is equivalent to approximately ¼" movement of the rail. In this example, the scaling factor is six. A higher degree of accuracy may be obtained by increasing the number of segments on the transparency wheel. For example, if the circumference of the shaft is approximately one inch, a transparency wheel having sixty-four segments provides a resolution of 1/64". In this example, the scaling factor is sixty-four.

Figure 12:
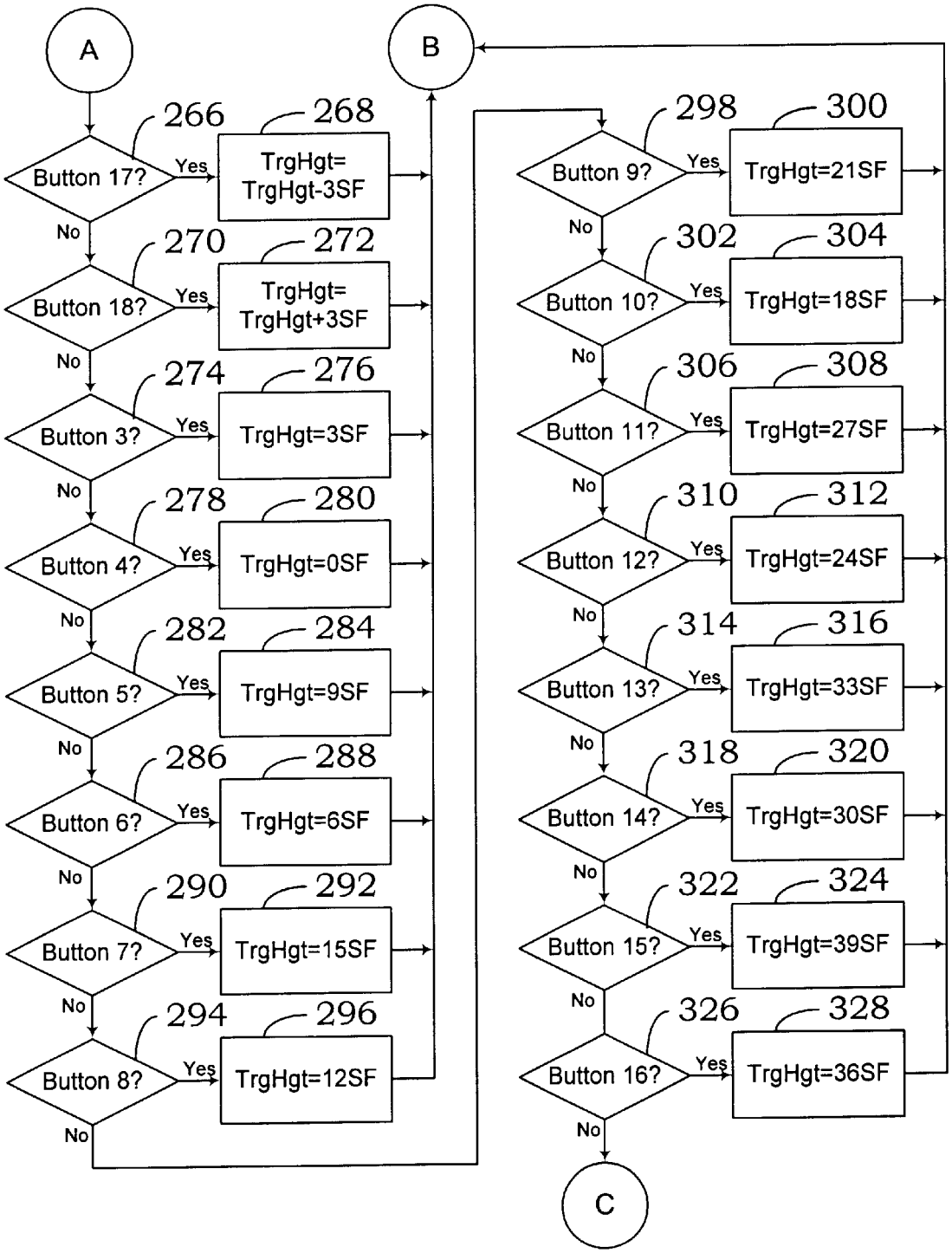

Referring to FIG. 12, if button 17 is pushed, decision block 266, then three times the scaling factor SF is added to the current target height variable TrgHgt, block 268, to move the rail down three inches. If button 18 is pressed, decision block 270, then three times the scaling faction is subtracted from the target height variable, block 272, to move the rail up three inches. The system sequentially checks each button until the pressed button is determined and then continues to "B" in the flowchart.

For each button pressed, target height variable is set to a multiple of the scaling factor. For example, if button 3 is pressed, decision block 274, the target height variable is set to three times the scaling factor, block 276, and processing continues to B to adjust the height of the rail. If button 4 is pressed, decision block 278, the target height variable is set to zero times the scaling factor, block 280, or the top of the post. If button 5 is pressed, decision block 282, then the target height variable is set to nine times the scaling factor, block 284. If button 6 is pressed, decision block 286, the target height variable is set to six times the scaling factor, block 288. If button 7 is pressed, decision block 290, then the target height variable is set to fifteen times the scaling factor, block 292. If button 8 is pressed, decision block 294, then the target height variable is set to twelve times the scaling factor, block 296. If button 9 is pressed, decision block 298, then the target height variable is set to twenty-one times the scaling factor, block 300. If button 10 is pressed, decision block 302, then the target height variable is set to eighteen times the scaling factor, block 304. If button 11 is pressed, decision block 306, then the target height variable is set to twenty-seven times the scaling factor, block 308. If button 12 is pressed, decision block 310, then the target height variable is set to twenty-four times the scaling factor, block 312. If button 13 is pressed, decision block 314, then the target height variable is set to thirty-three times the scaling factor, block 316. If button 14 is pressed, decision block 318, then the target height variable is set to thirty times the scaling factor, block 320. If button 15 is pressed, decision block 322, then the target height variable is set to thirty-nine times the scaling factor, block 324. If button 16 is pressed, decision block 326, then the target height variable is set to thirty-six times the scaling factor, block 328.

Figure 13:
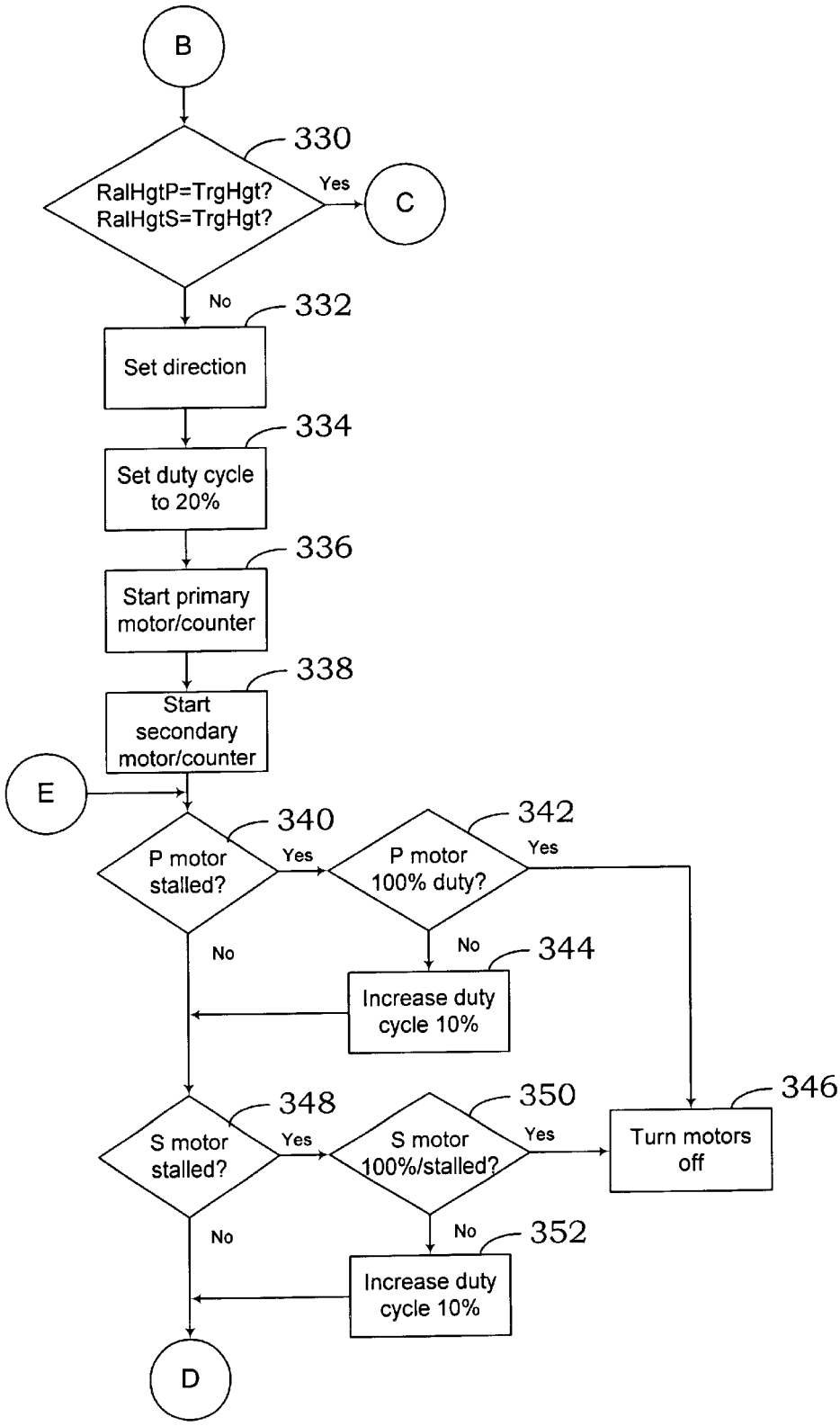

Once the button pressed has been determined, processing continues to "B" to block 330, FIG. 13. Because the target height does not equal the rail height primary or secondary, decision block 330, the system determines the direction of movement, block 332. If the target height is greater than the rail height (primary or secondary), then the direction of travel is down. If the target height is less than the rail height (primary or secondary), then the direction of travel is up. The duty cycle is set to 20% for each motor to slowly rotate the motors to raise or lower the rail, block 334. The microprocessor directs the motor control circuit of the primary motor to turn in a direction to lower or raise the rail and the rail height primary variable is decremented or incremented by one for each change in the output state of the primary rotation sensor, block 336. Likewise, the microprocessor directs the motor control circuit of the secondary motor to turn in the same direction as the primary motor to lower or lower the other side of the rail and the rail height secondary variable is decremented or incremented by one for each change in state of the secondary rotation sensor, block 338.

Figure 11:
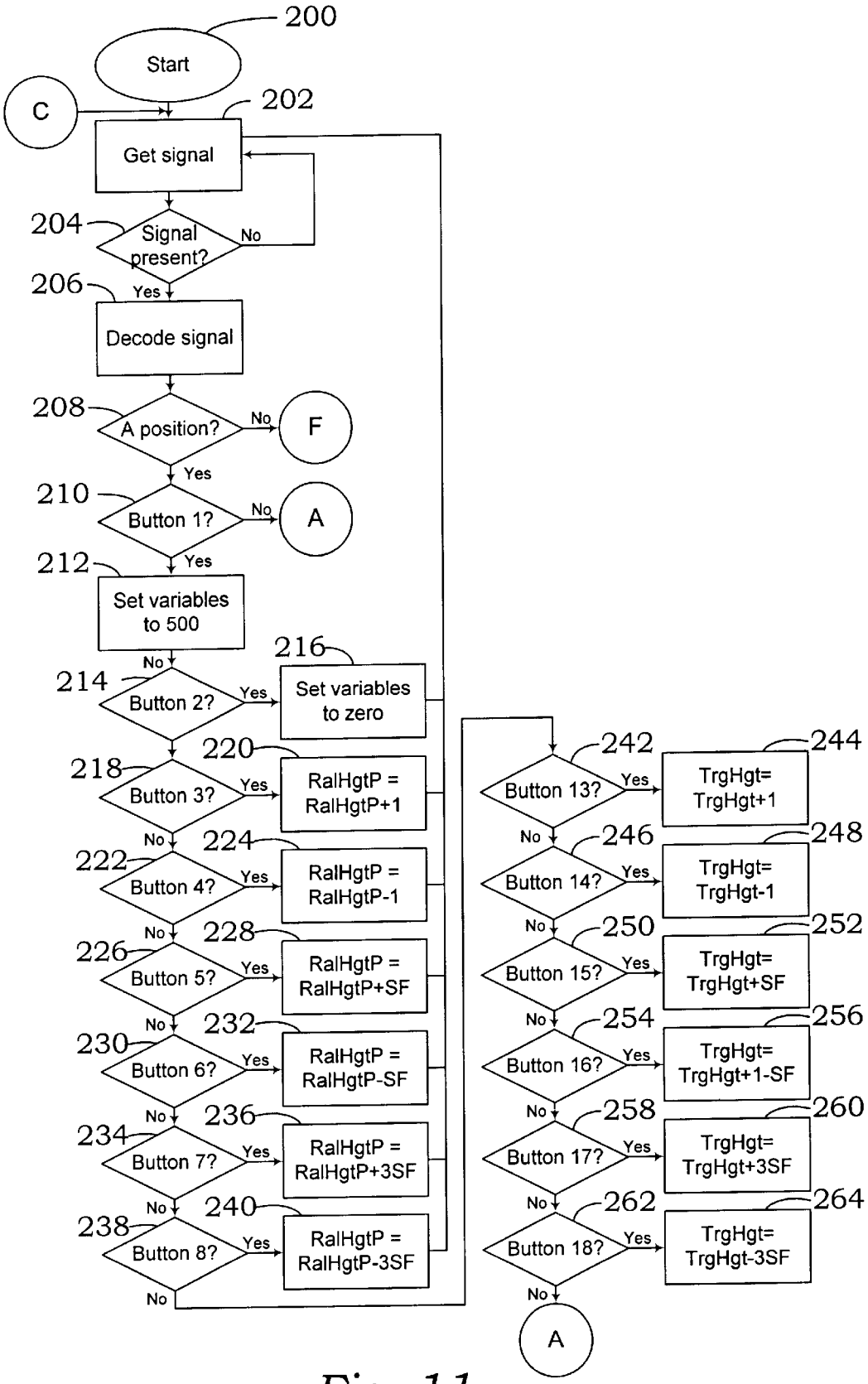
FIGS. 11–16 are software flow charts illustrating the system software.

If the primary rotational sensor does not change in a predetermined period, which indicates that the primary motor has stalled, decision block 340, then the duty cycle setting for the primary motor is checked. If the duty cycle for the primary motor is 100%, decision block 342, then both the primary and secondary motors are turned off, block 346. Processing returns to block 202 (FIG. 11). If the duty cycle for the primary motor is not 100%, decision block 342, then the duty cycle for the primary motor is increased by 10%, block 344.

If the secondary rotational sensor does not change in a predetermined period, which indicates that the secondary motor has stalled, decision block 348, then the duty cycle setting for the secondary motor is checked. If the duty cycle for the secondary motor is 100%, decision block 350, then both the primary and secondary motors are turned off, block 346, and processing returns to block 202 (FIG. 11). If the duty cycle for the secondary motor is not 100%, decision block 350, then the duty cycle is increased by 10%, block 352, and processing continues to "D".

If the rail height of the primary equals the target height, decision block 354, the primary motor is turned off, block 356. If the rail height of the secondary equals the target height, decision block 358, the secondary motor is turned off, block 360, and processing returns to "C" to the beginning (FIG. 11).

If the rail height of the primary does not equal the target height, decision block 354, the secondary height is checked. If the secondary height is equal to the target height, decision block 362, the secondary motor is turned off block 364 and processing returns to "E" (FIG. 13).

In operation, a rider may adjust the height of the rail without dismounting his or her horse and without disrupting a training session by simply pointing the remote at the jump and pressing the desired button to raise or lower the rail.

Referring to FIGS. 11, 15–17, if the selector switch is in the B position, decision block 208, processing goes to "F". If button 1 was pressed, decision block 372, the system enters into programming mode 4 and sets the target height, rail height primary and rail height secondary to 500, block 374. If button 2 is pressed, decision block 376, programming mode exits and the system saves the programmed variables for each button, sets the program variables to zero and returns to "C" to the start (FIG. 11). If button 2 is not pressed, decision block 376, processing continues to "H".

In programming mode 4, specific rail heights are assigned to the remote control buttons. For example, button 3 may not be set to 2½ feet, button 4 is set to 2 feet and button 5 set to 3 feet, 3 inches. The height of the rail is adjusted using button 17, decision block 380, to move the rail down, block 382, and button 18, decision block 384 to move the rail up, block 386. Once the target height is reached, this rail height is assigned to a remote control button by pushing the desired button.

For example, if button 3 is pressed, decision block 388, button 3 is assigned to the current rail height and stored, block 390. If button 4 is pressed, decision block 392, button 4 is assigned to the current rail height and stored, block 394. If button 5 is pressed, decision block 396, button 5 is assigned to the current rail height and stored, block 398. If button 6 is pressed, decision block 400, button 6 is assigned to the current rail height and stored, block 402. If button 7 is pressed, decision block 404, button 7 is assigned to the current rail height and stored, block 406. If button 8 is pressed, decision block 408, button 8 is assigned to the current rail height and stored, block 410. If button 9 is pressed, decision block 412, button 9 is assigned to the current rail height and stored, block 414. If button 10 is pressed, decision block 416, button 10 is assigned to the current rail height and stored, block 418. If button 11 is pressed, decision block 420, button 11 is assigned to the current rail height and stored, block 422. If button 12 is pressed, decision block 424, button 12 is assigned to the current rail height and stored, block 426. If button 13 is pressed, decision block 428, button 13 is assigned to the current rail height and stored, block 430. If button 14 is pressed, decision block 432, button 14 is assigned to the current rail height and stored, block 434. If button 15 is pressed, decision block 436, button 15 is assigned to the current rail height and stored, block 438. If button 16 is pressed, decision block 440, button 16 is assigned to the current rail height and stored, block 442. Once the button(s) has been programmed, the programming mode may be exited by pressing button 2, decision block 376, and control returns to "C" to the start.

Figure 14:
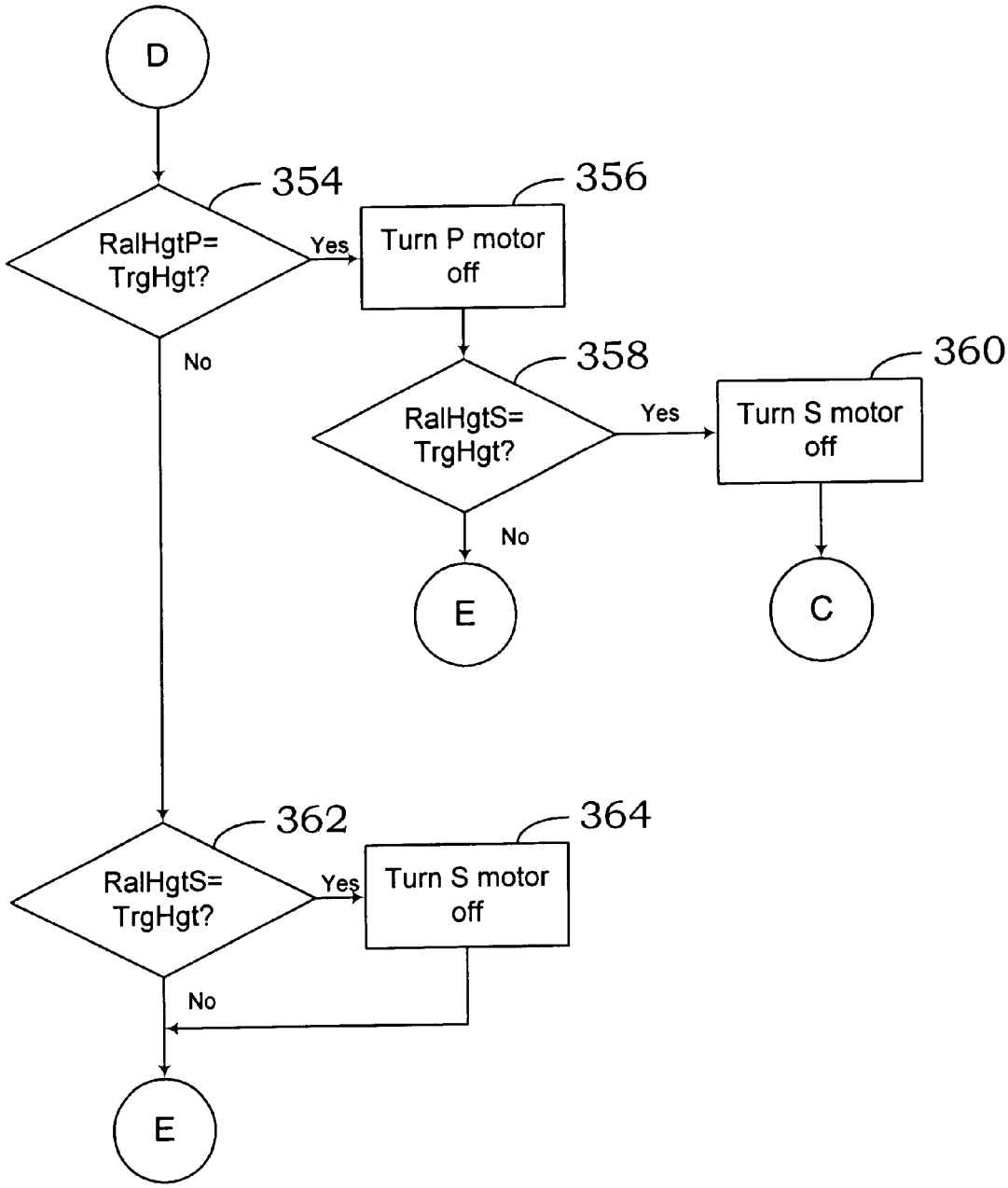
Figure 15:
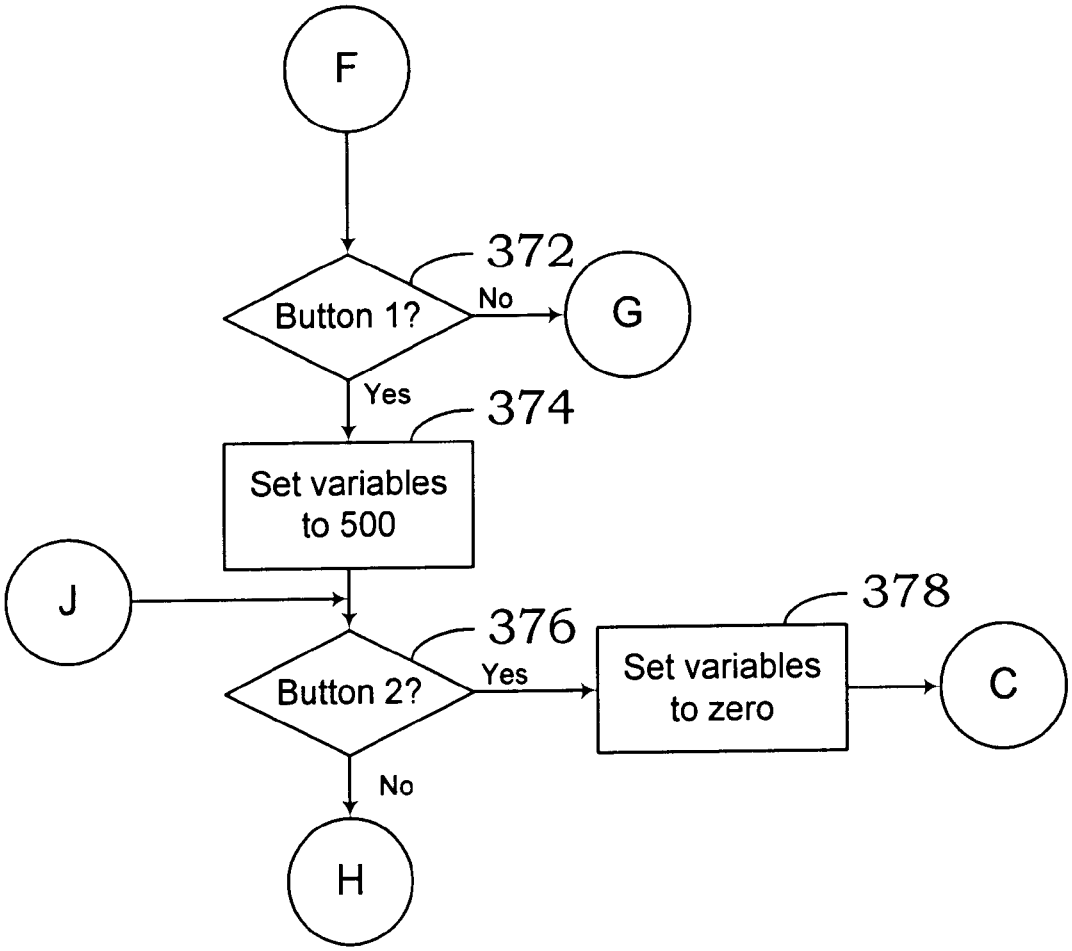
Figure 16:
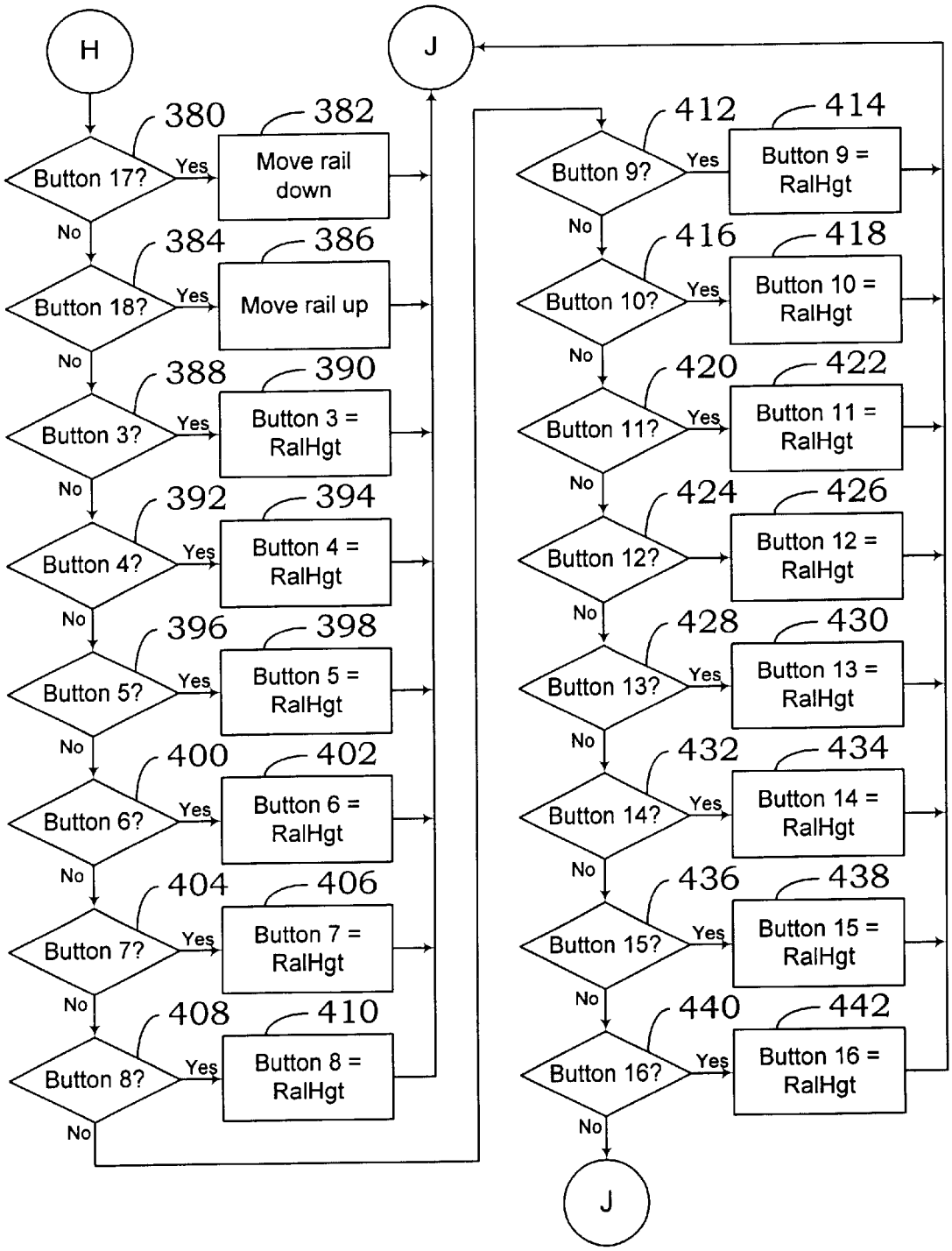

In operation in the B position, the rail height goes to the value stored for the programmed button using the same control algorithms as shown in FIGS. 13 and 14. In an arena with a plurality of jumps, each jump may be programmed to a different height associated with a single button. For example, button 3 may be programmed to eighteen inches for jump 1, twenty-one inches for jump 2, thirty-six inches for jump 3 and thirty inches for jump 4. By pressing button 3, each of the four jumps will move to the programmed height for that jump associated with button 3. For a large arena, the motor controllers may be linked directly to a personal computer via an RS-232, USB port, Ethernet port, or COM port connection for example, which may be used to control the height of each jump, or the computer may be connected to a transmitter to wirelessly control each jump.

Figure 17:
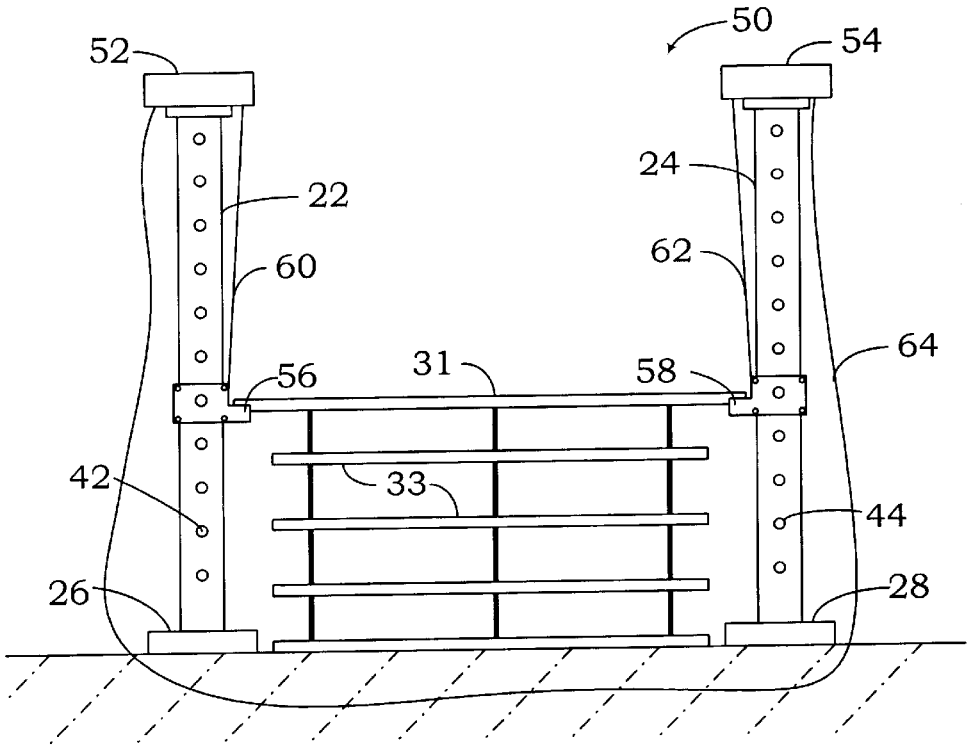
FIG. 17 is a front elevational view of a collapsible equestrian barrier with the present invention.

Referring to FIG. 17, the remotely adjustable equestrian barrier 50 may be used with an expandable rail 31 which includes slats 33 connected together and to rail 31. Slats 33 fold and unfold when rail 31 is lowered and raised.

Figure 18:
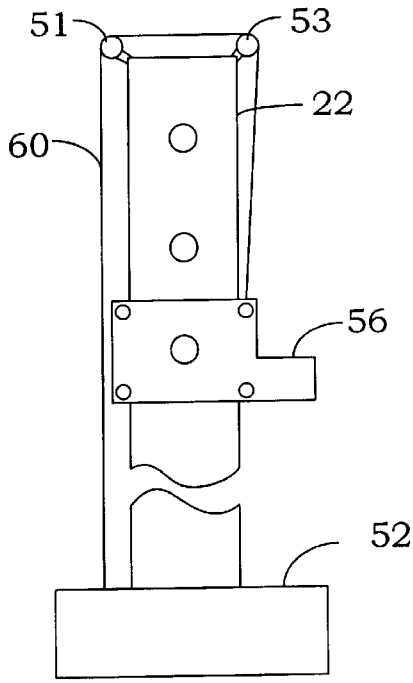
FIG. 18 is a front elevational view of a bottom-mounted controller housing.

Referring to FIG. 18, motor control housing 52 may be adapted to be located at the base of post 22 and connect to rolling jump cup 56 with line 60 over pulleys 51 and 53 secured to the top corners of post 22. Other configurations may be used to connect the motor control housings to the jump cups using lines or screws internal to the posts (not shown).

It is to be understood that while certain forms of this invention have been illustrated and described, it is not limited thereto except insofar as such limitations are included in the following claims and allowable equivalents thereof.

Having thus described the invention, what is claimed as new and desired to be secured by Letters Patent is as follows:

1. In combination with an equestrian barrier having spaced-apart first and second posts and a rail extending therebetween, an apparatus for remotely adjusting the height of said rail, said apparatus comprising:

first and second housings secured to said first and second posts respectively, first and second jump cups each having a cup portion and slidably secured to said first and second posts respectively, said rail extending between said jump cups and resting on said cup portion of each of said jump cups, first and second motors mounted in said first and second housings respectively, each of said motors having a drive shaft coupled to said first and second jump cups, first and second encoder wheels coupled to said first and second drive shafts respectively, first and second rotation detectors mounted in said first and second housings respectively proximal said first and second encoder wheels respectively for detecting rotation of said encoder wheels, a remote control transmitter for transmitting position information, a receiver mounted in said first housing for receiving said transmitted position information from said remote control transmitter, a controller mounted in said housing having a microprocessor, first and second motor controllers and a memory, said microprocessor electrically coupled to said motor controllers said memory, said receiver, and said position sensors, and a power means coupled to said controller and said motors, said microprocessor responsive to position information received from said receiver to determine a rail position and to enable said motor controllers to energize said motors to rotate in a predetermined direction, toward said rail position, said microprocessor responsive to rotational information received from said rotation detectors to disable said motor controllers to de-energize said motors when said rail position is generally reached.

2. The apparatus as claimed in claim 1 wherein said rail position is incremental position information.

3. The apparatus as claimed in claim 1 wherein said rail position is a predetermined rail height.

4. In combination with an equestrian barrier having spaced-apart first and second posts and a rail extending therebetween, an apparatus for remotely adjusting the height of said rail, said apparatus comprising:

first and second housings secured to said first and second posts respectively, first and second jump cups each having a cup portion slidably secured to said first and second posts respectively, said rail extending between said jump cups and resting on said cup portion of each of said jump cups, first and second means mounted in said first and second housings respectively and coupled to said first and second jump cups respectively for moving said first and second jump cups respectively from a first position to a second position, first and second positional detection means for determining the relative position of said first and second jump cups respectively, a means for transmitting position information, means for receiving said transmitted position information mounted in said first housing, a controller means responsive to said received position information from said receiver means to directionally energize each of said moving means, said controller means responsive to each of said positioned detection means to selectively de-energize each of said moving means.

5. The apparatus as claimed in claim 4 wherein said first and second moving means include first and second motors respectively.

6. The apparatus as claimed in claim 5 wherein said first and second moving means include first and second drive shafts coupled to said motors.

7. The apparatus as claimed in claim 6 wherein said first and second positional detection means include first and second encoder wheels coupled to said first and second drive shafts respectively.

8. The apparatus as claimed in claim 6 further comprising first and second encoder shafts coupled to said first and second drive shafts respectively.

9. The apparatus as claimed in claim 8 wherein said first and second positional detection means include first and second encoder wheels coupled to said first and second encoder shafts.

10. The apparatus as claimed in claim 4 wherein said first and second positional detection means include first and second encoder wheels coupled to said first and second moving means respectively.

11. The apparatus as claimed in claim 10 wherein said first and second positional detection means include first and second light detectors mounted in said first and second housings proximal said first and second encoder wheels, said light detectors responsive to rotation of said encoder wheels by said moving means.

12. The apparatus as claimed in claim 4 wherein said means for transmitting position information includes a remote control transmitter.

13. The apparatus as claimed in claim 4 wherein said means for transmitting position information includes a radio frequency remote transmitter.

14. The apparatus as claimed in claim 13 wherein said means for receiving includes a radio frequency receiver.

15. The apparatus as claimed in claim 4 wherein said means for transmitting position information includes an infrared remote transmitter.

16. The apparatus as claimed in claim 15 wherein said means for receiving includes an infrared receiver.

17. The apparatus as claimed in claim 4 wherein said means for transmitting position information includes a computer electrically connected to said means for receiving.

18. The apparatus as claimed in claim 17 wherein said means for receiving includes a communications port.

19. The apparatus as claimed in claim 4 wherein said controller means includes a microprocessor with a memory.

20. The apparatus as claimed in claim 4 wherein said positional detection means includes first and second laser range finders coupled to said controller means for providing positional data of said rail to said controller means.

* * * * *